US006717553B2

(12) United States Patent
Sasaki et al.

(10) Patent No.: US 6,717,553 B2
(45) Date of Patent: Apr. 6, 2004

(54) PRIMARY RADIATOR HAVING EXCELLENT ASSEMBLY WORKABILITY

(75) Inventors: Kazuhiro Sasaki, Fukushima-ken (JP); Masashi Nakagawa, Fukushima-ken (JP); Yuanzhu Dou, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/140,382

(22) Filed: May 6, 2002

(65) Prior Publication Data

US 2002/0167452 A1 Nov. 14, 2002

(30) Foreign Application Priority Data

May 11, 2001 (JP) ..... 2001-141926
May 22, 2001 (JP) ..... 2001-152647

(51) Int. Cl.[7] ..... H01Q 13/00
(52) U.S. Cl. ..... 343/786; 343/785; 333/21 A
(58) Field of Search ..... 343/785, 786, 343/756, 772; 333/21 A, 24.3; H01Q 13/00

(56) References Cited

U.S. PATENT DOCUMENTS 3,216,017 A 11/1965 Moore
3,605,101 A * 9/1971 Kolettis et al. ..... 343/783
3,815,136 A * 6/1974 Rootsey ..... 342/425
5,109,232 A * 4/1992 Monte ..... 343/785
5,550,553 A * 8/1996 Yamaki et al. ..... 343/785
5,936,589 A * 8/1999 Kawahata ..... 343/785
6,088,001 A * 7/2000 Burger et al. ..... 343/772
6,211,842 B1 * 4/2001 Cousin et al. ..... 343/840

FOREIGN PATENT DOCUMENTS

JP H11-004106 1/1999

* cited by examiner

*Primary Examiner*—Tho G. Phan
(74) *Attorney, Agent, or Firm*—Brinks Hofer Gilson & Lione

(57) ABSTRACT

A primary radiator including a waveguide formed by winding a metallic plate into a cylindrical shape and superimposing both ends thereof at a joining portion. Two first flat portions and two second flat portions, extending in the direction of the central axis of the waveguide, are formed so that a first flat portion and a second flat portion alternate at intervals of substantially 90 degrees, thereby forming a total of four flat portions. A dielectric feeder includes a radiator section, an impedance converting section, and a phase converting section. By inserting the dielectric feeder into the inside portion of the waveguide, both side surfaces of the phase converting section are press-fitted/secured to the first flat portions, and both mounting surfaces at the outer peripheral surface of the impedance converting section are press-fitted/secured to the second flat portions, so that the phase converting section intersects at an angle of approximately 45 degrees a probe protruding from the phase converting section in the direction of the central axis of the waveguide.

9 Claims, 7 Drawing Sheets

PRIMARY RADIATOR HAVING EXCELLENT ASSEMBLY WORKABILITY

BACKGROUND OF THE INVENTION

1. Field of the Invention

The present invention relates to a primary radiator used in, for example, a satellite-television reflective antenna, and, more particularly, to a primary radiator for sending and receiving circularly polarized electrical waves.

2. Description of the Related Art

A related primary radiator of this type will be described based on FIGS. 14 and 15. FIG. 14 is a sectional view of the related primary radiator, and FIG. 15 is a front view of the primary radiator viewed from a horn section. As shown in FIGS. 14 and 15, the related primary radiator comprises a circular cross-section waveguide 210 having a horn section 210*a* at one end thereof and having the other end formed as an enclosed surface 210*b*, a pair of ridges 211 formed at the inside wall surface of the waveguide 210 so as to protrude therefrom, and a probe 212 disposed between the ridges 211 and the enclosed surface 210*b*.

The waveguide 210 is molded out of a metallic material, such as zinc or aluminum, by die casting. Both of the ridges 211 are integrally formed with the waveguide 210. These ridges 211 function as phase changing members (90-degree phase devices) for changing circularly polarized waves that have traveled into the waveguide 210 from the horn section 210*a* into linearly polarized waves. The ridges 211 have tapered portions at both ends thereof along the central axis of the waveguide 210, and have predetermined heights, widths, and lengths. As shown in FIG. 15, when a plane including the central axis of the waveguide 210 and both ridges 211 is a reference plane, the probe 212 intersects the reference plane at an angle of approximately 45 degrees, and the distance between the probe 212 and the enclosed surface 210*b* is equal to about ¼ of a wavelength inside the waveguide. It is known that, instead of the ridges 211, plate members, formed of dielectric materials, may also be used as phase converting members. The dielectric plates are inserted into/secured to the inside of the waveguide 210. In that case, the probe 212 intersects at an angle of approximately 45 degrees a reference plane which is parallel to the surfaces of the dielectric plates and which passes the central axis of the waveguide 210.

In the primary radiator having such a structure, when a clockwise or a counterclockwise circularly polarized wave sent from, for example, a satellite is received, the circularly polarized wave is guided from the horn section 210*a* to the inside of the waveguide 210, and is converted into a linearly polarized wave when the circularly polarized wave passes the ridges 211 (or dielectric plates) inside the waveguide 210. More specifically, since the circularly polarized wave is a wave in which a combined vector of two linearly polarized waves having the same amplitudes, being perpendicular to each other, and having phase differences of 90 degrees rotates, when the circularly polarized wave passes the ridges 211 (or dielectric plates), the wave portions which have been out of phase by 90 degrees are caused to be in phase, so that the circularly polarized wave is converted into a linearly polarized wave. Therefore, when the linearly polarized wave is received as a result of coupling at the probe 212, it is possible to convert the received signal into an IF signal at a converter circuit (not shown), and to output the IF signal.

Conventionally, another known example of this type of primary radiator is a primary radiator comprising a waveguide having a horn section at one end thereof and having the other end formed as an enclosed surface, a phase converting member disposed inside the waveguide, and a probe installed between the phase converting member and the enclosed surface of the waveguide. The phase converting member converts a circularly polarized wave that has traveled into the waveguide into a linearly polarized wave. One example of the phase converting member is a dielectric plate having both longitudinal ends formed into a wedge shape. The probe intersects the phase changing member at an angle of approximately 45 degrees, and the distance between the probe and the enclosed surface of the waveguide is approximately ¼ of a wavelength inside the waveguide.

In the primary radiator having such a general structure, a clockwise or counterclockwise circularly polarized wave transmitted from a satellite is guided to the inside of the waveguide from the horn section and is converted into a linearly polarized wave at the phase converting member. More specifically, since the circularly polarized wave is a wave in which a combined vector of two linearly polarized waves having the same amplitude, being perpendicular to each other, and having phase differences of 90 degrees rotates, when the circularly polarized wave passes the phase converting member, the wave portions which have been out of phase by 90 degrees are caused to be in phase, so that the circularly polarized wave is converted into a linearly polarized wave. Therefore, when the linearly polarized wave is received as a result of coupling at the probe, the received signal is converted into an IF signal at a converter circuit (not shown), and the IF signal is output.

However, in each of the related primary radiators constructed as described above, the waveguide is molded out of a metallic material, such as zinc or aluminum, by die casting, so that an expensive molding die having a complicated structure is required, which is a big factor in increasing production costs of the primary radiator. In recent years, to overcome this problem, an attempt to form the waveguide by winding a metallic plate into a cylindrical shape has been made in order to eliminate the use of an expensive die-casting mold. However, such a waveguide gives rise to new problems with regard to the phase converting member or members.

More specifically, in the waveguide formed by winding a metallic plate into a cylindrical shape, it is difficult to form a large protrusion on a thin metallic plate by pressing, so that, even if the protrusion is successfully formed, the protrusion have low dimensional precision. Therefore, when a ridge is used as a phase converting member, it is difficult to process. On the other hand, when a dielectric plate is used as a phase converting member, since the inner peripheral surface of the waveguide formed by winding a metallic plate is circular, it is necessary to bond the phase converting member to a predetermined location inside the waveguide while the phase converting member inserted into the waveguide is positioned with a jig at the stage of assembling the primary radiator. Therefore, the assembly work becomes very complicated.

In each of the primary radiators of this type, since the probe and the phase converting member or members intersect at an angle of approximately 45 degrees inside the waveguide, it is necessary to secure the phase converting member or members inserted into the waveguide with proper means. In general, a bonding agent is used as such means for securing the phase converting member or members. However, in the securing method using a bonding agent, it is necessary to perform the complicated step of applying the bonding agent to a joining portion of the inside wall surface of the waveguide and the phase converting member or members while the phase converting member or members are positioned with a jig. Therefore, the problem that assembly workability is poor arises. A method of securing the phase converting member or members to the inside portion of the waveguide with a screw as another securing means has been proposed. In this case, the front end portion of the screw protrudes into the waveguide, thereby giving rise to the problem of reduced performance resulting from reflection of electrical waves at the front end portion of the screw.

SUMMARY OF THE INVENTION

The present invention has been achieved in view of the problems of the related art, and has as its first object the provision of a primary radiator which has excellent assembly workability and which can be produced at a low cost. The present invention has as its second object the provision of a primary radiator whose phase converting member can be easily and reliably secured without a reduction in performance.

To these ends, according to a first aspect of the present invention, there is provided a primary radiator comprising a waveguide formed by winding a metallic plate into a cylindrical shape, a probe protruding from an inside wall surface of the waveguide in a direction of a central axis of the waveguide, and a dielectric feeder held by the waveguide. In the primary radiator, a flat portion extending parallel to the central axis of the waveguide is formed at the inside wall surface of the waveguide, and the dielectric feeder is mounted to the flat portion.

In the primary radiator having such a structure, since the waveguide is formed by winding a metallic plate into a cylindrical shape, it can be produced at a considerably reduced cost than when a waveguide formed by die casting. In addition, in the case where the dielectric feeder is mounted to the waveguide, when a portion of the dielectric feeder inserted into the waveguide is mounted to the flat portion of the metallic plate, the relative positions of the waveguide and the dielectric feeder are determined by this flat portion, so that assembly work can be simplified.

In the above-described structure, the flat portion can be formed at any location of the inside wall surface of the waveguide. However, when the structure of the first aspect is used, there may be used a first form in which the flat portion is formed at a joining portion formed by winding the metallic plate into a cylindrical shape and superimposing the end portions thereof.

When the structure of the first aspect is used, there may be used a second form in which the dielectric feeder comprises a radiator section protruding from an open end of the waveguide, an impedance converting section which becomes narrower from the radiator section towards an inside portion of the waveguide, and a plate-shaped phase converting section formed continuously with the impedance converting section, with the phase converting section intersecting the probe at an angle of approximately 45 degrees. When the structure of the second form is used, there may be used a third form in which two such flat portions are formed at two opposing locations of the waveguide on both sides of the central axis of the waveguide, and in which the phase converting section of the dielectric feeder is mounted to the flat portions. Therefore, it is possible to readily and reliably position the phase converting member and the probe relative to each other.

When the structure of the second form is used, there may be used a fourth form in which a plurality of the flat portions are formed at a plurality of locations of an inner peripheral surface of the waveguide, and in which the impedance converting section and the phase converting section of the dielectric feeder are each mounted to the flat portions, so that the dielectric feeder can be more stably mounted to the waveguide. When the structure of the fourth form is used, there may be used a fifth form in which four such flat portions are formed at four locations at an interval of approximately 90 degrees in a peripheral direction of the waveguide, so that the pair of flat portions to which the impedance converting section is mounted and the pair of flat portions to which the phase converting section is mounted are substantially orthogonal to each other. Therefore, it is possible to restrict adverse effects of each flat portion on polarized waves.

According to a second aspect of the present invention, there is provided a primary radiator comprising a waveguide including an opening at one end side, a phase converting member inserted into an inside portion of the waveguide from the opening, a plurality of retainer portions for securing the phase converting member to an inside wall surface of the waveguide, and a probe which intersects the phase converting member at an angle of approximately 45 degrees inside the waveguide. In the primary radiator, each retainer portion is separated by an interval of approximately ¼ of a wavelength inside the waveguide in a same plane running through a central axis of the waveguide.

In the primary radiator having such a structure, since the phase converting member inserted into the waveguide is secured to the inside wall surface of the waveguide by a plurality of retainer portions, it is possible to simplify assembly work. In addition, since the interval between each retainer portion is set at approximately ¼ of the wavelength inside the waveguide, it is possible to reduce a reflection component by cancellation of reflections of electrical waves at the corresponding retainer portions.

In the above-described structure, it is possible to use a waveguide molded out of, for example, zinc or aluminum by die casting. However, when the waveguide is formed of a metallic plate and is formed by winding the metallic plate into a cylindrical shape or a prismatic shape, it becomes unnecessary to use an expensive molding die, so that it is preferable to use such a waveguide from the viewpoint of reduced production costs of the waveguide. In this case, when a plurality of cut-up portions are formed at the inside wall surface of the metallic plate, of which the waveguide is formed, by bending portions of the metallic plate, the phase converting member can be secured to the inside wall surface of the waveguide by these cut-up portions serving as retainer portions. Alternatively, the phase converting member can be secured by using a plurality of screws as retainer portions and screwing the screws into the waveguide from mount holes formed in the waveguide.

DESCRIPTION OF THE PREFERRED EMBODIMENTS

Figure 1:
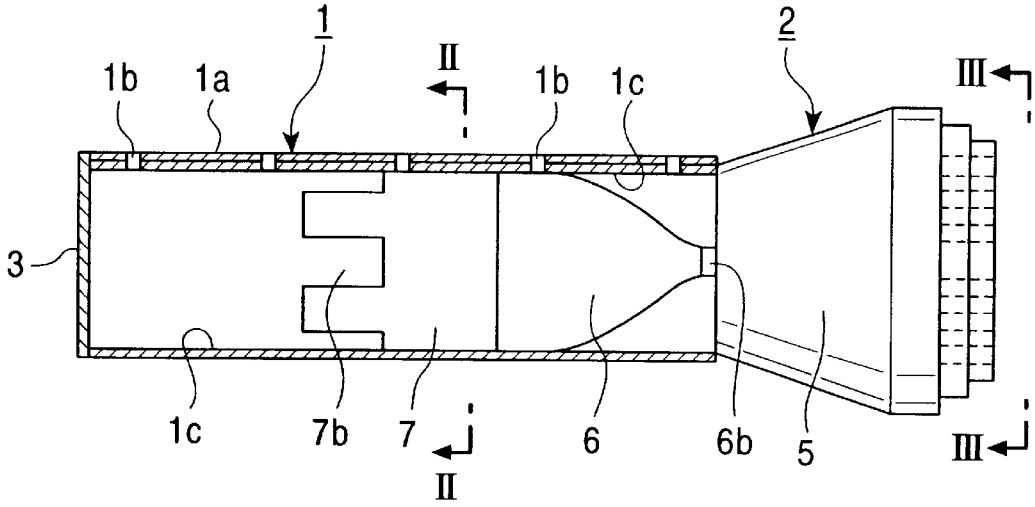
FIG. 1 illustrates the structure of a primary radiator of a first embodiment of the present invention.
Figure 2:
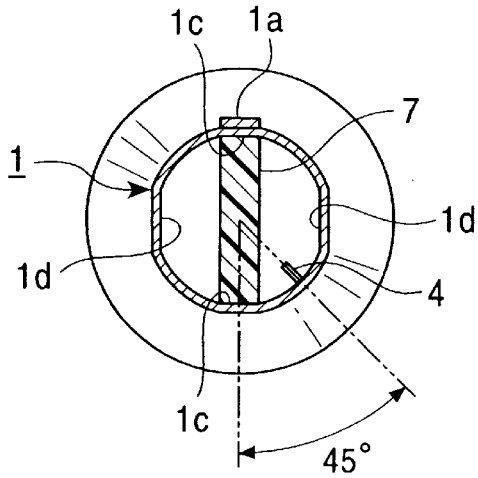
FIG. 2 is a sectional view taken along line II—II of FIG. 1.
Figure 3:
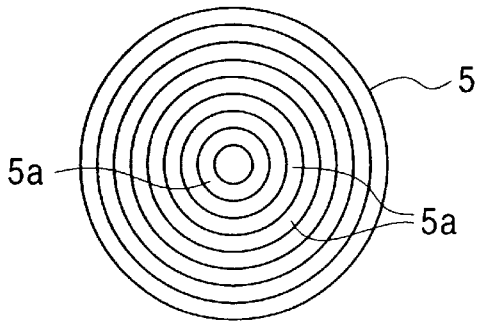
FIG. 3 is a front view in the direction of arrow III—III shown in FIG. 1.
Figure 4:
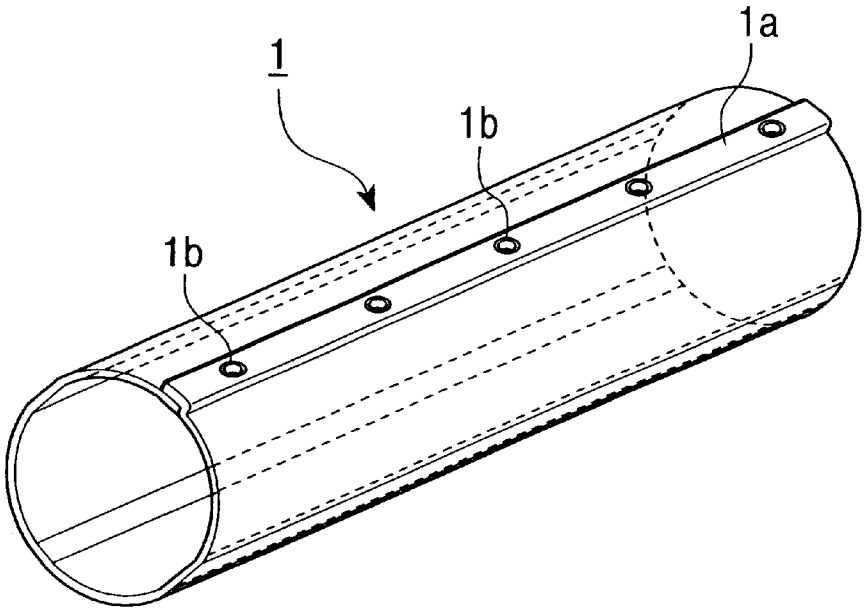
FIG. 4 is a perspective view of a waveguide of the primary radiator.
Figure 5:
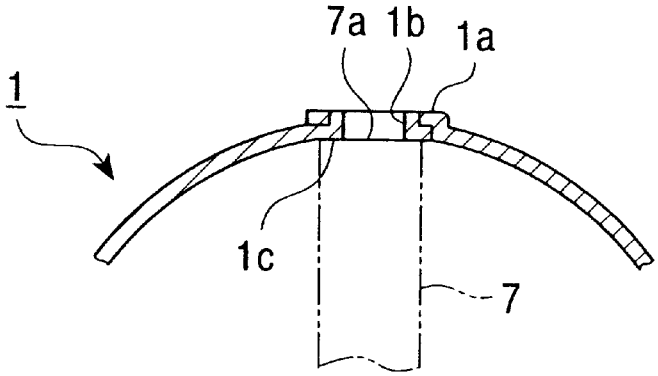
FIG. 5 is a sectional view of the main portion of the waveguide.
Figure 6:
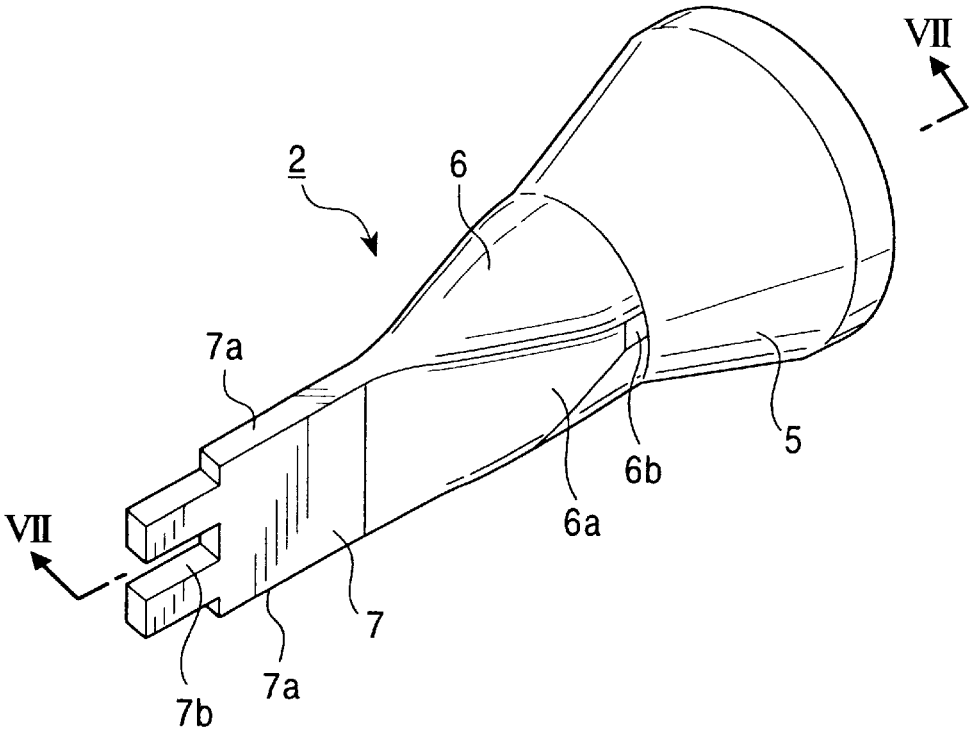
FIG. 6 is a perspective view of a dielectric feeder of the primary radiator.
Figure 7:
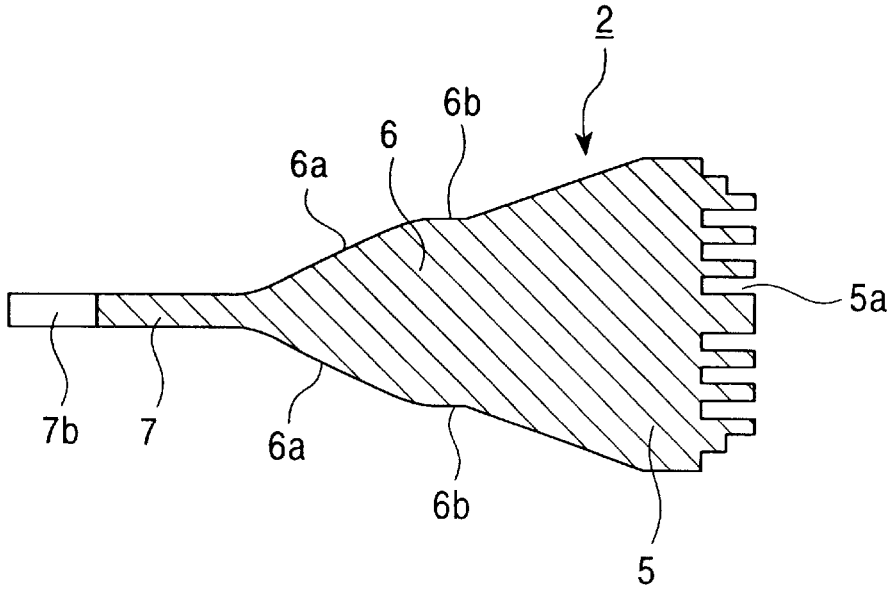
FIG. 7 is a sectional view taken along line VII—VII of FIG. 6.

Hereunder, a description of a first embodiment of the present invention will be given with reference to the relevant drawings. FIG. 1 illustrates the structure of a primary radiator of the first embodiment of the present invention. FIG. 2 is a sectional view along line II—II of FIG. 1. FIG. 3 is a front view in the direction of arrow III—III shown in FIG. 1. FIG. 4 is a perspective view of a waveguide of the primary radiator. FIG. 5 is a sectional view of the main portion of the waveguide. FIG. 6 is a perspective view of a dielectric feeder of the primary radiator. FIG. 7 is a sectional view along line VII—VII shown in FIG. 7.

As shown in these figures, the primary radiator of the first embodiment comprises a cylindrical waveguide 1 having both ends thereof open, a dielectric feeder 2 held at the inside portion of the waveguide 1, and a cover member 3 covering one of the open ends of the waveguide 1. A probe 4 is installed at the inside wall surface of the waveguide 1, and is connected, at the outside portion of the waveguide 1, to a converter circuit (not shown). Although not shown in FIG. 1, the distance between the probe 4 and the cover member 3 is set at approximately ¼ of a wavelength $\lambda g$ inside the waveguide.

The waveguide 1 is formed by winding a rectangular metallic plate in a spread state into a cylindrical shape. As shown in FIG. 4, both ends of the metallic plate are superimposed upon each other to form a joining portion 1*a*. As shown in FIG. 5, at the joining portion 1*a*, both ends of the metallic plate are secured at a plurality of caulked portions 1*b*, with the distance between each caulked portion 1*b* being set at approximately ¼ of the wavelength $\lambda g$ inside the waveguide. The waveguide 1 is substantially circular in cross section, and has a pair of first flat portions 1*c* and a pair of second flat portions 1*d* at portions of the inner peripheral surface of the waveguide 1. The flat portions 1*c* and the flat portions 1*d* extend in a longitudinal direction parallel to the central axis of the waveguide 1. When viewed in a peripheral direction of the waveguide 1, the two first flat portions 1*c* and the two second flat portions 1*d* are formed so that a first flat portion 1*c* and a second flat portion 1*d* alternate at intervals of substantially 90 degrees, thereby forming a total of four flat portions. In other words, as shown in FIG. 2, at orthogonal coordinate lines that pass through the central axis of the waveguide 1, the two first flat portions 1*c* oppose each other at an interval of 180 degrees from each other on one straight line, while the two second flat portions 1*d* oppose each other at an interval of 180 degrees on the other straight line perpendicular to the one straight line. One of the flat portions 1*c* and 1*d* is formed at the joining portion 1*a*. In the case of the first embodiment, one first flat portion 1*c* is formed at the joining portion 1*a*.

The dielectric feeder 2 is formed of a dielectric material having a low dielectric dissipation factor. In the case of the first embodiment, considering costs, low-cost polyethylene (dielectric constant $\epsilon$ is approximately equal to 2.25) is used as the dielectric material. The dielectric feeder 2 comprises a radiator section 5 protruding from the uncovered open end of the waveguide 1, an impedance converting section 6 which becomes narrower in an arcuate shape from the radiator section 5 towards the inside portion of the waveguide 1, and a phase converting section 7 extending continuously from the tapered portion of the impedance converting section 6. As described later, two portions of the peripheral surface of the impedance converting section 6 and both side surfaces of the phase converting section 7 are mounted to the corresponding flat portions 1*c* and 1*d*.

The radiator section 5 widens in the shape of a trumpet from the uncovered open end of the waveguide 1. A plurality of annular grooves 5*a* are formed in an end surface of the radiator section 5. The depth of each annular groove 5*a* is set at approximately ¼ of a wavelength $\lambda_o$ of an electrical wave that propagates in air. Each annular groove 5*a* is concentrically formed in the end surface of the radiator section 5 (see FIG. 3).

The impedance converting section 6 has a pair of curved surfaces 6*a* that converge towards the phase converting section 7 from the base end portion of the impedance converting section 6 disposed towards the radiator section 5. The cross sectional shape of each curved surface 6*a* is approximately a quadratic curve shape. The base end portion of the impedance converting section 6 is formed with an approximately circular surface. Flat mounting surfaces 6*b* are formed at two locations of the outer peripheral surface of the impedance converting section 6 so as to oppose each other at an interval of 180 degrees. The mounting surfaces 6*b* are press-fitted/secured to the corresponding second flat portions 1*d* of the waveguide 1.

The phase converting section 7 is a plate-shaped member having a substantially uniform thickness, and functions as a 90-degree phase device for converting a circularly polarized wave that has moved into the dielectric feeder 2 into a linearly polarized wave. The phase converting section 7 is formed continuously with the tapered portion of the impedance converting section 6 formed opposite to the base end portion. A straight line that connects both mounting surfaces 6*b* of the impedance converting section 6 and a straight line that connects both side surfaces 7*a* of the phase converting section 7 are orthogonal to each other. As shown in FIG. 2, both side surfaces 7*a* of the phase converting section 7 are press-fitted/secured to the corresponding first flat portions 1*c* of the waveguide 1. When a plane which is parallel to a plate surface of the phase converting section 7 and which passes through the central axis of the waveguide 1 is a reference plane, the probe 4 intersects the reference plane at an angle of approximately 45 degrees. A plurality of cutaway portions 7*b* are formed in an end surface of the phase converting section 7 disposed at a side opposing the cover member 3. Steps are formed by these cutaway portions 7*b*. The depths of the cutaway portions 7*b* are set at approximately ¼ of the wavelength $\lambda g$ inside the waveguide. This end surface of the phase converting section 7 and the bottom surfaces defining the cutaway portions 7*b* form two reflecting surfaces that are perpendicular to each other in the direction of propagation of an electrical wave.

In the primary radiator having such a structure, when a clockwise or counterclockwise circularly polarized wave which has been sent from, for example, a satellite is received, the circularly polarized wave travels into the dielectric feeder 2 from the end surface of the radiator section 5. After propagating from the radiator section 5 to the phase converting section 7 through the impedance converting section 6 inside the dielectric feeder 2, the circularly polarized wave is converted into a linearly polarized wave at the phase converting section 7, and the linearly polarized wave travels inside the waveguide 1. Then, the linearly polarized wave input to the waveguide 1 is coupled at the probe 4. By converting a reception signal from the probe 4 into an IF signal at a converter circuit (not shown) for output, it is possible to receive the circularly polarized wave sent from, for example, a satellite.

Here, since the plurality of annular grooves 5*a* having depths approximately equal to $\lambda/4$ wavelength are formed in the end surface of the radiator section 5 of the dielectric feeder 2, the phases of electrical waves reflected at the end surface of the radiator section 5 and the bottom surfaces defining the annular grooves 5*a* are reversed and canceled, so that reflection components of the electrical waves moving towards the end surface of the radiator section 5 are greatly reduced. In addition, since the radiator section 5 is formed into the shape of a trumpet that widens from the uncovered open end of the waveguide 1, the electrical waves can be efficiently converged at the dielectric feeder 2, and the length of the radiator section 5 in the axial direction can be reduced. Further, by forming the impedance converting section 6 between the phase converting section 7 and the radiator section 5 of the dielectric feeder 2, and by continuously forming the cross-sectional forms of the pair of curved surfaces 6*a* of the impedance converting section 6 into approximately quadratic curve shapes, the curved surfaces 6*a* converge so that the dielectric feeder 2 becomes gradually thinner towards the phase converting section 7 from the radiator section 5. Therefore, not only can the reflection components of the electrical waves that propagate inside the dielectric feeder 2 be effectively reduced, but also a portion extending from the impedance converting section 6 to the phase converting section 7 functions as a phase converting section. Consequently, from this point also, the overall length of the dielectric feeder 2 can be greatly reduced. Still further, the cutaway portions 7*b* having depths of approximately $\lambda g/4$ wavelengths are formed in the end surface of the phase converting section 7 of the dielectric feeder 2, so that the phases of the electrical waves reflected at the bottom surfaces defining the cutaway portions 7*b* and the end surface of the phase converting section 7 are reversed and canceled, so that impedance mismatching at the end surface of the phase converting section 7 can be eliminated.

In the primary radiator of the first embodiment, since the waveguide 1 is formed by winding a metallic plate into a cylindrical shape, it is not necessary to use an expensive die-casting mold, so that production costs of the waveguide 1 can be significantly reduced accordingly. In addition, since the pair of first flat portions 1*c* extending parallel to the central axis are formed at the inner peripheral surface of the waveguide 1, and both side surfaces 7*a* of the phase converting section 7 of the dielectric feeder 2 inserted into the waveguide 1 are press-fitted/secured to the first flat portions 1*c*, the phase converting section 7 can be positioned with high precision without using a special jig, so that assembly work can be simplified. It is possible to increase the strength of mounting the dielectric feeder 2 by using a bonding agent along with the first flat portions 1*c*. In this case also, when the bonding agent is applied, the phase converting section 7 is positioned by the first flat portions 1*c*, so that it is not necessary to use a positioning jig.

In forming the waveguide 1, since the joining portion 1*a* formed by superimposing both ends of a metallic plate is secured at the plurality of caulked portions 1*b*, and the one first flat portion 1*c* is formed at the joining portion 1*a*, the joining portion 1*a* and the first flat portion 1*c* can be formed at the same time at the waveguide 1, so that the joining portion 1*a* can be easily secured by caulking. In addition, since the distance between each caulked portion 1*b* is set at approximately ¼ of the wavelength $\lambda g$ inside the waveguide, it is possible to cancel the phases of the electrical waves reflected at the corresponding caulked portions 1*b*.

Further, since the pair of second flat portions 1*d* are formed separately of the first flat portions 1*c* at the inner peripheral surface of the waveguide 1, and the mounting surfaces 6*b*, formed at the outer peripheral surface of the impedance converting section 6 of the dielectric feeder 2, are press-fitted/secured to their corresponding second flat portions 1*d*, the strength of mounting the dielectric feeder 2 and anti-rotation effect are increased, so that the dielectric feeder 2 can be stably secured to the waveguide 1. In addition, since the flat portions 1*c* and the flat portions 1*d* are formed so that a flat portion 1*c* and a flat portion 1*d* alternate at an interval of substantially 90 degrees at the inner peripheral surface of the waveguide 1, the straight line connecting the pair of first flat portions 1*c* and the straight line connecting the pair of second flat portions 1*d* are orthogonal to each other, so that it is possible to restrict adverse effects of each flat portion 1*c* and each flat portion 1*d* on the polarized waves.

Figure 8:
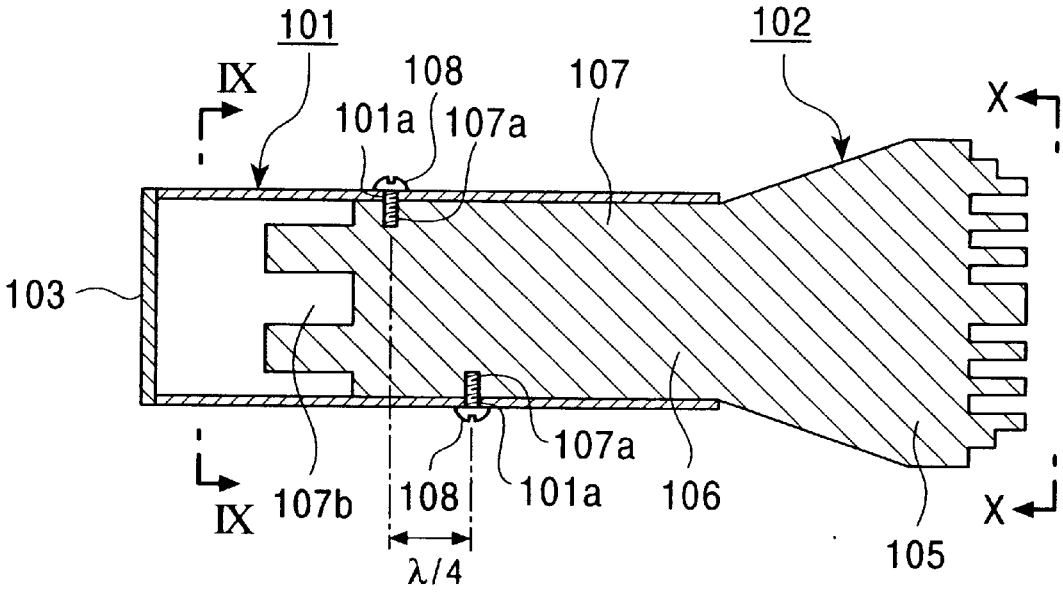
FIG. 8 illustrates the structure of a primary radiator of a second embodiment of the present invention.
Figure 9:
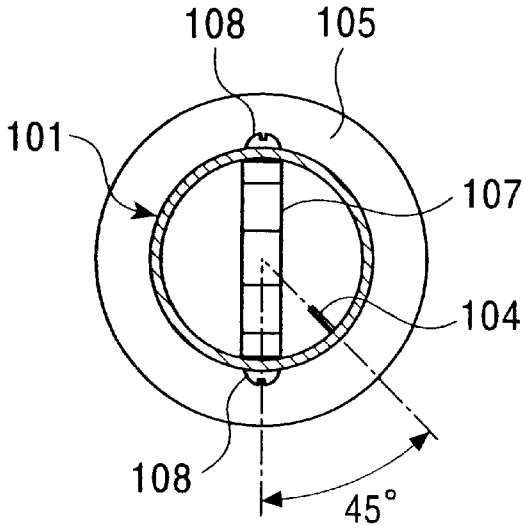
FIG. 9 is a sectional view taken along line IX—IX of FIG. 8.
Figure 10:
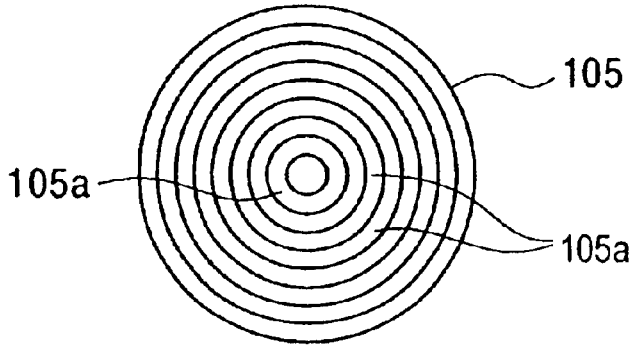
FIG. 10 is a front view in the direction of arrow X—X of FIG. 8.
Figure 11:
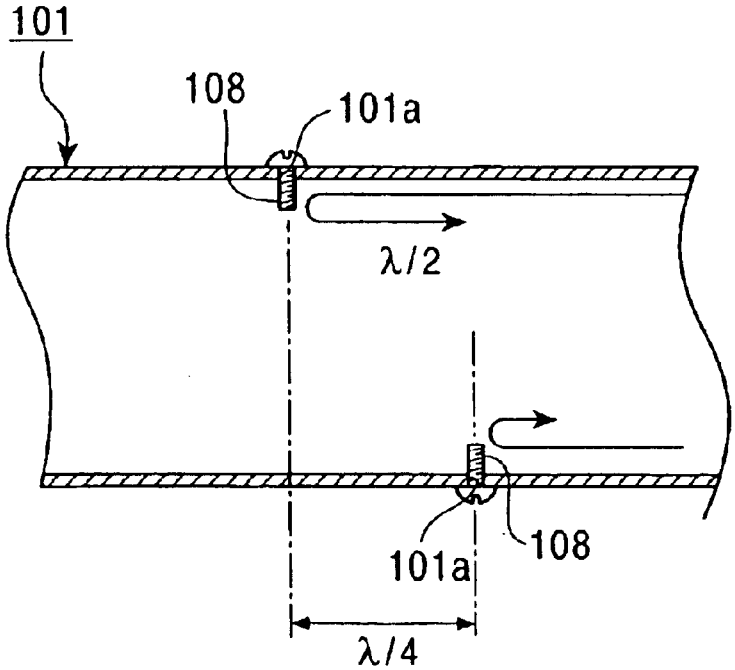
FIG. 11 illustrates the operation for canceling reflections.

Next, a description of a second embodiment of the present invention will be given with reference to the relevant drawings. FIG. 8 illustrates the structure of a primary radiator of the second embodiment of the present invention. FIG. 9 is a sectional view along line IX—IX of in FIG. 8. FIG. 10 is a front view in the direction of arrow X—X shown in FIG. 8. FIG. 6 is a perspective view of a dielectric feeder of the primary radiator. FIG. 7 is a sectional view taken along line VII—VII of FIG. 6. FIG. 11 illustrates the operation for canceling reflections.

As shown in these figures, the primary radiator of the second embodiment comprises a cylindrical waveguide 101 having both ends thereof open, a dielectric feeder 102 held at the inside portion of the waveguide 101, and a cover member 103 covering one of the open ends of the waveguide 101. A probe 104 is installed at the inside wall surface of the waveguide 101, and is connected, at the outside portion of the waveguide 101, to a converter circuit (not shown). Although not shown in FIG. 8, the distance between the probe 104 and the cover member 103 is set at approximately ¼ of a wavelength $\lambda g$ inside the waveguide.

The waveguide 101 is formed by winding a rectangular metallic plate in a spread state into a cylindrical shape. Both ends of the metallic plate are superimposed upon each other and are joined together. A pair of mount holes 101*a* are formed in the waveguide 101, are positioned in the same plane running through the central axis of the waveguide 101, and are separated by approximately ¼ of the wavelength inside the waveguide along the axial direction of the waveguide 101.

The dielectric feeder 102 is formed of a dielectric material having a low dielectric dissipation factor. In the case of the second embodiment, considering costs, low-cost polyethylene (dielectric constant $\epsilon$ is approximately equal to 2.25) is used as the dielectric material. The dielectric feeder 102 comprises a radiator section 105 protruding from the uncovered open end of the waveguide 101, an impedance converting section 106 which becomes narrower in an arcuate shape from the radiator section 105 to the inside portion of the waveguide 101, and a phase converting section 107 extending continuously from the tapered portion of the impedance converting section 6.

The radiator section 105 widens in the shape of a trumpet from the uncovered open end of the waveguide 101. A plurality of annular grooves 105*a* are formed in an end surface of the radiator section 105. The depth of each annular groove 105*a* is set at approximately ¼ of a wavelength λ of an electrical wave that propagates through the annularly grooved portion. Each annular groove 105*a* is concentrically formed in the end surface of the radiator section 105 (see FIG. 10).

The impedance converting section 106 has a pair of curved surfaces 106*a* (shown in FIG. 12) that converge towards the phase converting section 107 from the base end portion of the impedance converting section 106 disposed towards the radiator section 105. The cross sectional shape of each curved surface 106*a* is approximately a quadratic curve shape. The base end portion of the impedance converting section 106 is formed as an approximately circular surface, and is press-fitted/secured to the uncovered open end of the waveguide 101.

The phase converting section 107 is a plate-shaped member having a substantially uniform thickness, and functions as a 90-degree phase device for converting a circularly polarized wave that has moved into the dielectric feeder 102 into a linearly polarized wave. The phase converting section 107 is formed continuously with the tapered portion of the impedance converting section 106 formed opposite to the base end portion. Recesses 107*a* opposing the mount holes 101*a* of the waveguide 101 are formed in both side surfaces of the phase converting section 107. A pair of screws 108 are inserted into the corresponding mount hole 101 from outside the waveguide 101. By screwing the screws 108 into the waveguide 101 and retaining them by the corresponding recesses 107*a*, the phase converting section 107 is secured to the inside portion of the waveguide 101 by the pair of screws 108 serving as retainer portions. As shown in FIG. 9, when a plane which is parallel to a plate surface of the phase converting section 107 and which passes through the central axis of the waveguide 101 is a reference plane, the probe 104 intersects the reference plane at an angle of approximately 45 degrees. A plurality of cutaway portions 107*b* are formed in an end surface of the phase converting section 107 disposed at a side opposing the cover member 103. Steps are formed by these cutaway portions 107*b*. The depths of the cutaway portions 107*b* are set at approximately ¼ of the wavelength λg inside the waveguide 101. The end surface of the phase converting section 107 and the bottom surfaces defining the cutaway portions 107*b* are formed into two reflecting surfaces where phases differ by 90 degrees with respect to the direction of propagation of electrical waves.

In the primary radiator having such a structure, when a clockwise or counterclockwise circularly polarized wave which has been sent from, for example, a satellite is received, the circularly polarized wave travels into the dielectric feeder 102 from the end surface of the radiator section 105. After propagating from the radiator section 105 to the phase converting section 107 through the impedance converting section 6 inside the dielectric feeder 102, the circularly polarized wave is converted into a linearly polarized wave at the phase converting section 107, and the linearly polarized wave travels inside the waveguide 101. Then, the linearly polarized wave input to the waveguide 101 is coupled at the probe 104. By converting a reception signal from the probe 104 into an IF signal at a converter circuit (not shown) for output, it is possible to receive the circularly polarized wave sent from, for example, a satellite.

Here, since the plurality of annular grooves 105*a* having depths approximately equal to λ/4 wavelength are formed in the end surface of the radiator section 105 of the dielectric feeder 102, the phases of the electrical waves reflected at the end surface of the radiator section 105 and the bottom surfaces defining the annular grooves 105*a* are reversed and canceled, so that reflection components of the electrical waves moving towards the end surface of the radiator section 105 are greatly reduced. In addition, since the radiator section 105 is formed into the shape of a trumpet that widens from the uncovered open end of the waveguide 101, the electrical waves can be efficiently converged at the dielectric feeder 102, and the length of the radiator section 105 in the axial direction can be reduced. Further, by forming the impedance converting section 106 between the phase converting section 107 and the radiator section 105 of the dielectric feeder 102, and by continuously forming the cross-sectional forms of the pair of curved surfaces 106*a* of the impedance converting section 6 into approximately quadratic curve shapes, the curved surfaces 106*a* converge so that the dielectric feeder 102 becomes gradually thinner towards the phase converting section 107 from the radiator section 105. Therefore, not only can the reflection components of the electrical waves that propagate inside the dielectric feeder 102 be effectively reduced, but also a portion extending from the impedance converting section 106 to the phase converting section 107 functions as a phase converting section. Consequently, from this point also, the overall length of the dielectric feeder 102 can be greatly reduced. Still further, the cutaway portions 107*b* having depths of approximately λg/4 wavelengths are formed in the end surface of the phase converting section 107 of the dielectric feeder 102, so that the phases of the electrical waves reflected at the bottom surfaces defining the cutaway portions 107*b* and the end surface of the phase converting section 107 are reversed and canceled, so that impedance mismatching at the end surface of the phase converting section 107 can be eliminated.

In the primary radiator of the second embodiment, since the waveguide 101 is formed by winding a metallic plate into a cylindrical shape, it is not necessary to use an expensive die-casting mold, so that production costs of the waveguide 101 can be significantly reduced accordingly. Since the phase converting section 107 of the dielectric feeder 102 is inserted into the waveguide 101, and is secured to the inside portion of the waveguide 101 with the pair of screws 108, the phase converting section 7 can be positioned/secured with high precision even if a special jig is not used, thereby making it possible to simplify assembly work. In addition, since the interval between both screws 108 extending into the inside portion of the waveguide 101 is set at approximately ¼ of the wavelength inside the waveguide, as shown in FIG. 6, reflection at one of the screws 108 and reflection at the other screw 108 are shifted by approximately ½ wavelength (=180 degrees) and canceled, so that it is possible to prevent a reduction in performance caused by reflection at the screws 108. It is possible to increase the strength of mounting the dielectric feeder 102 by using a bonding agent along with the screws 108. In this case also, when the bonding agent is applied, the phase converting section 107 is secured by the screws 108, so that it is not necessary to use a positioning jig.

Figure 12:
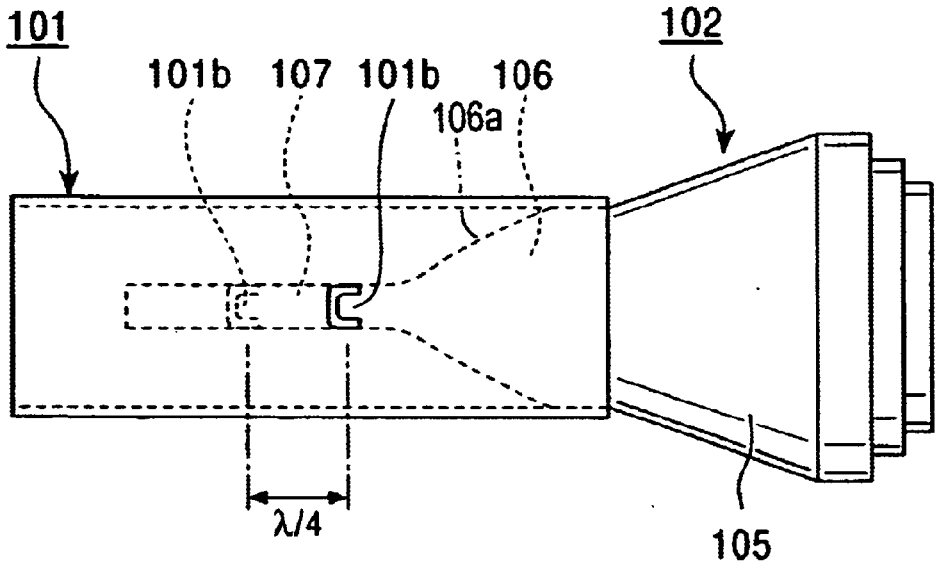
FIG. 12 illustrates the structure of a primary radiator of a third embodiment of the present invention.
Figure 13:
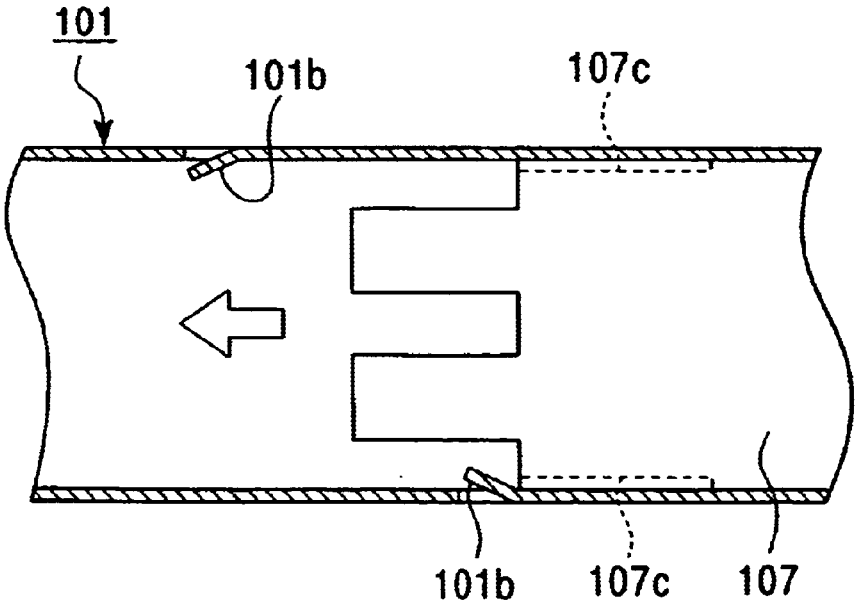
FIG. 13 illustrates the main portion of the primary radiator.
Figure 14:
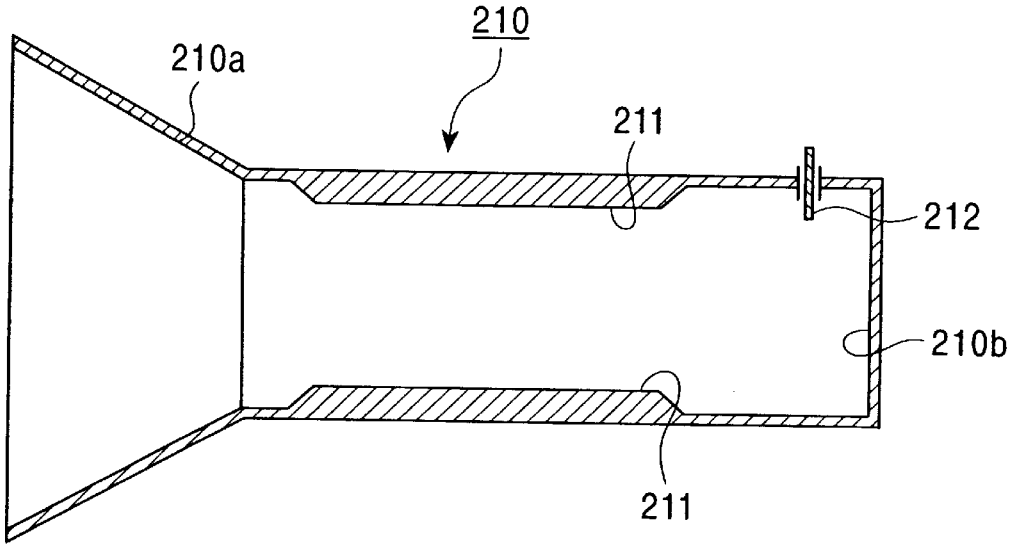
FIG. 14 PRIOR ART
FIG. 14 is a sectional view of a related primary radiator.
Figure 15:
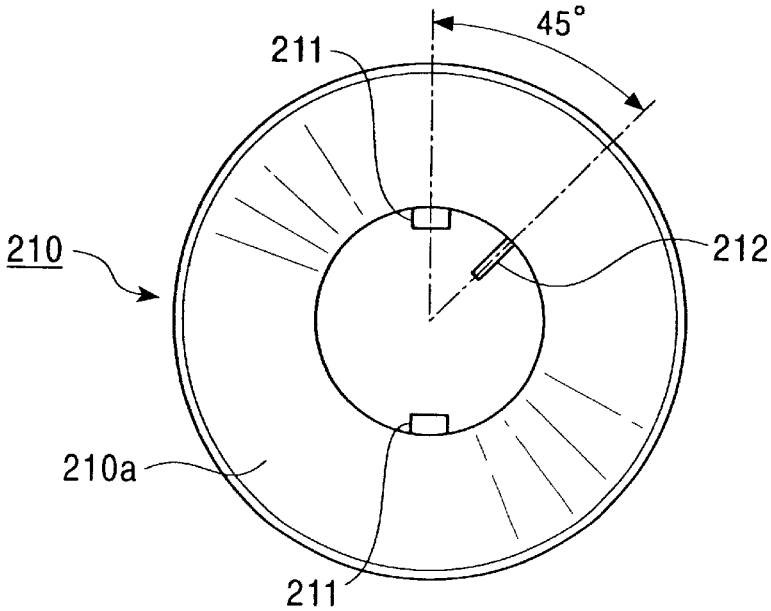
FIG. 15 PRIOR ART
FIG. 15 is a front view of the related primary radiator viewed from a horn section of the primary radiator.

FIG. 12 illustrates the structure of a primary radiator of a third embodiment of the present invention. FIG. 13 illustrates the main portion of the primary radiator. Corresponding parts to those shown in FIGS. 6 to 10 are given the same reference numerals.

The third embodiment differs from the second embodiment in that a pair of cut-up portions 101*b* are formed at the inside wall surface of the waveguide 101 by bending portions of the waveguide 101, and that a phase converting section 107 is secured to the inside portion of the waveguide 101 by the cut-up portions 101*b* serving as retainer portions. The other structural features are basically the same. More specifically, like the mount holes 101*a* used in the second embodiment, the pair of cut-up portions 101*b* are formed at the inside wall surface of a metallic plate, which is used as a material for the waveguide 101, are positioned in the same plane running through the central axis of the waveguide 101, and are separated by approximately ¼ of a wavelength inside the waveguide along the axial direction of the waveguide 101. On the other hand, recessed grooves 107*c* extending in the longitudinal direction are formed in both side surfaces of the phase converting section 107. As shown in FIG. 13, by inserting the phase converting section 107 into the waveguide 101, and by retaining an end of each cut-up portion 101*b* by its corresponding recessed groove 107*c*, the phase converting section 107 is positioned/secured to the inside portion of the waveguide 101 in order to prevent the dielectric feeder 102 from becoming dislodged.

Even in the third embodiment of the primary radiator having such a structure, the interval between both cut-up portions 101*b* that secure the phase converting section 107 is set at approximately ¼ of the wavelength inside the waveguide, so that reflections at both cut-up portions 101*b* are canceled, thereby making it possible to prevent a reduction in performance. In addition, since the cut-up portions 101*b* formed by bending portions of the waveguide 101 are formed as retainer portions at the inside wall surface of the waveguide 101, fewer component parts can be used in the third embodiment than in the second embodiment where screws are used as retainer portions, so that assembly workability is improved.

Although, in the relevant embodiments, the case where a pair of retainer portions (the screws 108 or cut-up portions 101*b*) are disposed 180 degrees apart from each other on both sides of the central axis of the waveguide 101 so as to oppose each other is described, as long as the condition that the interval between each retainer portion is approximately ¼ of the wavelength inside the waveguide is satisfied, each retainer portion may be disposed at a location opposing one of the side surfaces of the phase converting section 107.

Although, in each of the relevant embodiments, a primary radiator where the radiator section 5, the impedance converting section 106, and the phase converting section 107 are integrally molded at the dielectric feeder 102, and where the dielectric feeder 102 is held by the waveguide 101, formed of a metallic plate, is described, the present invention may be applied to a primary radiator in which a waveguide including a horn section is formed by die casting, and in which a dielectric plate, serving as a phase converting member, is held inside the waveguide. In this case, the dielectric plate is secured to the inside portion of the waveguide by a securing method which is similar to the securing method using the screws 108 described in the second embodiment.

The present invention is carried out in the forms described above, and provides the following advantages.

Since the waveguide is formed by winding a metallic plate into a cylindrical shape, flat portions extending parallel to the central axis of the waveguide are formed at the inside wall surface of the waveguide, and a dielectric feeder is mounted to the flat portions as positioning reference surfaces, compared to the case where a waveguide formed by die casting, not only are production costs considerably reduced, but also the dielectric feeder can be readily positioned with respect to the waveguide with high precision. Therefore, it possible to provide a primary radiator which has excellent assembly workability and which can be produced at a low cost.

In addition, since the phase converting section inserted into the waveguide is secured to the inside wall surface of the waveguide by a plurality of retainer portions, which are either screws or cut-up portions, it is possible to simplify assembly work because it is not necessary to use a special positioning jig. Further, since the interval between each retainer portion is set at approximately ¼ of a wavelength inside the waveguide, reflection at each retainer portion is canceled, so that each reflection component can be reduced.

What is claimed is:

1. A primary radiator comprising:

a waveguide formed by winding a metallic plate into a cylindrical shape;

a probe protruding from an inside wall surface of the waveguide in a direction of a central axis of the waveguide; and a dielectric feeder held by the waveguide, wherein a flat portion extending parallel to the central axis of the waveguide is formed at the inside wall surface of the waveguide, and wherein the dielectric feeder is mounted to the flat portion.

2. A primary radiator according to claim 1, wherein the waveguide includes a joining portion formed by superimposing end portions of the metallic plate, and wherein the flat portion is formed at the joining portion.

3. A primary radiator according to claim 1, wherein the dielectric feeder comprises a radiator section protruding from an open end of the waveguide, an impedance converting section which becomes narrower from the radiator section towards an inside portion of the waveguide, and a plate-shaped phase converting section formed continuously with the impedance converting section, with the phase converting section intersecting the probe at an angle of approximately 45 degrees.

4. A primary radiator according to claim 3, wherein two such flat portions are formed at two opposing locations of the waveguide on both sides of the central axis of the waveguide, and wherein the phase converting section is mounted to the flat portions.

5. A primary radiator according to claim 3, wherein a plurality of the flat portions are formed at a plurality of locations of an inner peripheral surface of the waveguide, and wherein the impedance converting section and the phase converting section are each mounted to the flat portions.

6. A primary radiator according to claim 5, wherein four such flat portions are formed at four locations at an interval of approximately 90 degrees in a peripheral direction of the waveguide.

7. A primary radiator comprising:

a waveguide formed by winding a metallic plate into a cylindrical shape and including an opening at one end side;

a phase converting member inserted into an inside portion of the waveguide from the opening;

a plurality of retainer portions for securing the phase converting member to an inside wall surface of the waveguide; and a probe which intersects the phase converting member at an angle of approximately 45 degrees inside the waveguide, wherein each retainer portion is separated by an interval of approximately ¼ of a wavelength inside the waveguide in a direction of a central axis of the waveguide.

8. A primary radiator according to claim 7, wherein the retainer portions are cut-up portions formed at the inside wall surface of the waveguide by bending.

9. A primary radiator according to claim 7, wherein a plurality of mount holes are formed in the waveguide, and wherein the retainer portions are screws inserted into the mount holes and screwed into the waveguide.

* * * * *